US010769938B1

(12) United States Patent
Chen et al.

(10) Patent No.: US 10,769,938 B1
(45) Date of Patent: Sep. 8, 2020

(54) SMOKE DETECTION METHOD, SMOKE DETECTION DEVICE, SMOKE ALARM AND STORAGE MEDIUM

(71) Applicant: SITERWELL ELECTRONICS CO., LIMITED, Ningbo, Zhejiang Province (CN)

(72) Inventors: Dongfang Chen, Zhejiang (CN); Xingxing Huang, Zhejiang (CN); Qingqin Shi, Zhejiang (CN)

(73) Assignee: SITERWELL ELECTRONICS CO., LIMITED, Ningbo, Zhejiang Province (CN)

( * ) Notice: Subject to any disclaimer, the term of this patent is extended or adjusted under 35 U.S.C. 154(b) by 0 days.

(21) Appl. No.: 16/524,706

(22) Filed: Jul. 29, 2019

(30) Foreign Application Priority Data

May 28, 2019 (CN) ..... 2019 1 0452375

(51) Int. Cl.

| | |
|---|---|
| ***G08B 29/00*** | (2006.01) |
| ***G08B 29/18*** | (2006.01) |
| ***G08B 29/14*** | (2006.01) |
| ***G08B 17/107*** | (2006.01) |

(52) U.S. Cl.
CPC ..... *G08B 29/185* (2013.01); *G08B 17/107* (2013.01); *G08B 29/145* (2013.01)

(58) Field of Classification Search
CPC ... G08B 29/185; G08B 17/107; G08B 29/145
USPC ..... 340/628–633
See application file for complete search history.

(56) References Cited

U.S. PATENT DOCUMENTS

| | | | | |
|---|---|---|---|---|
| 4,163,969 | A * | 8/1979 | Enemark | G08B 17/107 250/574 |
| 5,864,293 | A * | 1/1999 | Lewiner | G08B 17/107 250/574 |
| 6,166,647 | A * | 12/2000 | Wong | G08B 17/10 340/522 |
| 6,218,950 | B1 * | 4/2001 | Politze | G06K 9/00 340/619 |
| 6,225,910 | B1 * | 5/2001 | Kadwell | G08B 17/107 250/573 |
| 7,623,028 | B2 * | 11/2009 | Kates | G01N 33/0065 340/521 |
| 7,760,102 | B2 * | 7/2010 | Chabanis | G08B 17/107 340/584 |
| 8,629,779 | B2 * | 1/2014 | Aebersold | G08B 17/107 340/628 |
| 8,907,802 | B2 * | 12/2014 | Erdtmann | G08B 17/107 250/573 |

(Continued)

*Primary Examiner* — Ojiako K Nwugo
(74) *Attorney, Agent, or Firm* — Muncy, Geissler, Olds & Lowe, P.C.

(57) ABSTRACT

The invention discloses a smoke detection method, which comprises the steps of: adjusting a detection period of a smoke alarm to be a rapid detection period when a smoke density is detected to meet a set density threshold; calculating a ratio of an electrical signal increment caused by a first transmitted signal to an electrical signal increment caused by a second transmitted signal; and increasing a smoke alarm threshold when smoke is judged not to be caused by a fire hazard based on the ratio. In the invention, different types of smoke can be identified and different alarm modes can be selected to solve the problem of a false alarm.

9 Claims, 3 Drawing Sheets

(56) References Cited

U.S. PATENT DOCUMENTS 8,994,942 B2 * 3/2015 Vollenweider ..... G01N 21/53 250/574
2004/0056765 A1 * 3/2004 Anderson ..... A62C 35/08 340/522
2005/0173638 A1 * 8/2005 Powell ..... G01N 21/0303 250/341.1
2005/0200475 A1 * 9/2005 Chen ..... G08B 17/10 340/521
2008/0246623 A1 * 10/2008 Nagashima ..... G01N 21/21 340/630
2009/0009347 A1 * 1/2009 Kaelin ..... G08B 17/107 340/630
2009/0140868 A1 * 6/2009 Booth ..... G08B 17/10 340/628
2010/0039274 A1 * 2/2010 Cole ..... G01N 21/53 340/630
2011/0057805 A1 * 3/2011 Loepfe ..... G08B 29/22 340/628
2012/0126975 A1 * 5/2012 Gonzales ..... G08B 29/20 340/540
2012/0235822 A1 * 9/2012 Barson ..... G08B 17/113 340/630
2014/0160473 A1 * 6/2014 McKendree ..... G01N 21/532 356/244
2015/0031381 A1 * 1/2015 Kotecha ..... H04W 4/70 455/452.1
2015/0096352 A1 * 4/2015 Peterson ..... G08B 25/002 73/31.02
2015/0103346 A1 * 4/2015 Erdtmann ..... G08B 29/043 356/338
2015/0371515 A1 * 12/2015 Zribi ..... G08B 17/107 340/630
2018/0350220 A1 * 12/2018 Gonzales ..... G08B 17/117

* cited by examiner

SMOKE DETECTION METHOD, SMOKE DETECTION DEVICE, SMOKE ALARM AND STORAGE MEDIUM

FIELD OF THE INVENTION

The invention belongs to the technical field of security, and particularly relates to a smoke detection method, a smoke detection device, a smoke alarm and a storage medium.

BACKGROUND OF THE INVENTION

Smoke alarms are generally mounted in large buildings such as residential quarters, public areas and office sites. Since smoke is generated by the burning of objects, a plurality of smoke alarms are arranged in a building according to their coverage. Smoke alarms include photoelectric smoke alarms and the like from the perspective of the sensors used, wherein such photoelectric smoke alarm is internally provided with an optical chamber consisting of a transmitter, a receiver and a chamber. The chamber consists of relatively complicated light reflecting and refracting surfaces or ribs in structure. After the unique processing of light, smoke enters this special structural cavity and the smoke density can be indicated. In the absence of smoke, the receiver can only receive a small amount of light emitted by the transmitter. When smoke enters the optical chamber, the receiver receives more light by refraction and reflection, and an intelligent alarm circuit judges whether the collected smoke density exceeds an alarm threshold, if yes, an alarm is sounded.

For the smoke normally generated in daily life, for example, smoke that will also be generated by kitchen cooking, steak grilling and barbecue, these kinds of smoke will also allow alarms to sound alarm signals, but these alarms are false alarms.

SUMMARY OF THE INVENTION

An embodiment of the invention provides a smoke detection method, which aims to solve the problem of a false alarm by a smoke alarm.

An embodiment of the invention provides a smoke detection method, which comprises the steps of:

adjusting a current detection period of a smoke alarm to be a rapid detection period to accelerate the detection frequency of the smoke density when a current smoke density is detected to meet a set density threshold;

calculating a ratio of an electrical signal increment caused by a first transmitted signal to an electrical signal increment caused by a second transmitted signal; and increasing a smoke alarm threshold of the smoke alarm when smoke is judged not to be caused by a fire hazard based on the ratio; wherein, the wavelength of the first transmitted signal is different from that of the second transmitted signal.

An embodiment of the invention further provides a smoke detection device comprising:

a detection period adjustment unit for adjusting a current detection period of a smoke alarm to be a rapid detection period to accelerate the detection frequency of the smoke density when a current smoke density is detected to meet a set density threshold;

a ratio calculation unit for calculating a ratio of an electrical signal increment caused by a first transmitted signal to an electrical signal increment caused by a second transmitted signal; and an alarm threshold adjustment unit for increasing a smoke alarm threshold of the smoke alarm when smoke is judged not to be caused by a fire hazard based on the ratio; wherein the wavelength of the first transmitted signal is different from that of the second transmitted signal.

An embodiment of the invention provides a smoke alarm, which comprises the smoke detection device provided by the above embodiment.

An embodiment of the invention further provides a smoke alarm, which comprises a processor, and a memory connected to the processor via a communication bus; wherein, the memory is configured to store a smoke detection program; and the processor is configured to execute the smoke detection program to implement the steps of the smoke detection method.

An embodiment of the invention further provides a storage medium storing one or more programs, wherein the one or more programs are executable by one or more processors to enable the one or more processors to execute the steps of the smoke detection method.

In the embodiment of the invention, a smoke density detection period is adjusted to accelerate the detection frequency of smoke, a ratio of an electrical signal increment caused by a first transmitted signal to an electrical signal increment caused by a second transmitted signal is calculated to judge the type of smoke so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm. In the invention, different types of smoke can be identified and different alarm modes can be selected to solve the problem of a false alarm by the smoke alarm.

DETAILED DESCRIPTION OF THE INVENTION

In order to make the objects, technical solutions and advantages of the invention clearer, the invention will be further described below in detail with reference to the drawings and embodiments. It should be understood that the particular embodiments described herein are only used to explain the invention and not intended to limit the invention.

In the embodiment of the invention, a smoke density detection period is adjusted to accelerate the detection frequency of smoke, a ratio of an electrical signal increment caused by a first transmitted signal to an electrical signal increment caused by a second transmitted signal is calculated to judge the type of smoke so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm.

Figure 1:
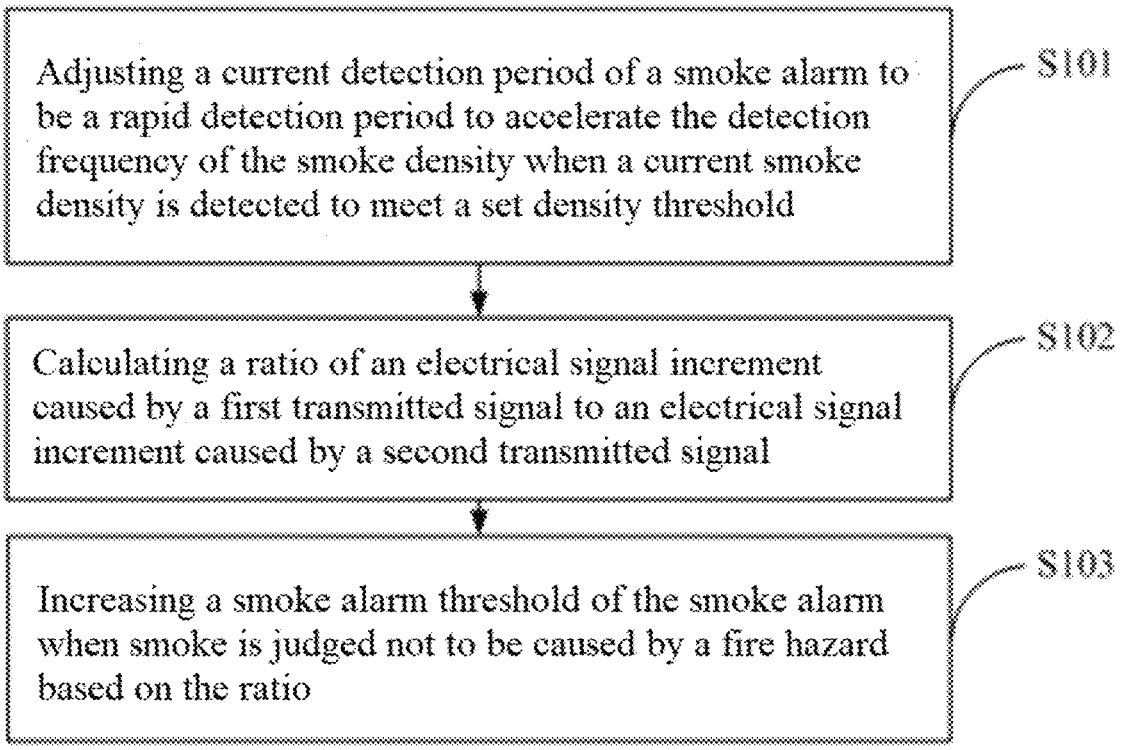
FIG. 1 is a flow chart of a smoke detection method provided by an embodiment of the invention.

As shown, FIG. 1 is a flow chart of a smoke detection method provided by an embodiment of the invention, which will be described below in detail.

In S5101, a current detection period of a smoke alarm is adjusted to be a rapid detection period to accelerate the detection frequency of the smoke density when a current smoke density is detected to meet a set density threshold.

The smoke alarm is generally supplied with power by a battery. In order to extend the service life of the battery, the smoke alarm detects smoke once at a predetermined time (for example, every 8 seconds) under the normal standby condition, i.e. clean air, which can save power consumption and does not affect smoke detection.

In S102, a ratio of an electrical signal increment caused by a first transmitted signal to an electrical signal increment caused by a second transmitted signal is calculated. Specifically, received signal values generated by a signal receiver after two transmitters transmit signals are relatively fixed under clean air, but when smoke enters a sensor, received electrical signals generated by the receiver after the transmitters transmit signals increase. The higher the smoke density, the greater the electrical signal until the electrical signal is saturated. Since the wavelength of the signals transmitted by the two transmitters is different, different electrical signal increments are generated by the same smoke, and their electrical signal increments have a certain fixed ratio; and since the particle size of different kinds of smoke is different, different signal increment values are generated by the same transmitted signal, such that received electrical signal increments generated by the signal receiver after the two signal transmitters transmit signals for different types of smoke have different ratios, thus different types of smoke can be distinguished based on such ratio. For example, the ratio of signal value increments generated by burning newspaper is 2; and the ratio of signal value increments generated by grilling steaks is 3. The second transmitted signal is visible light or infrared light.

In S103, a smoke alarm threshold of the smoke alarm is increased when smoke is judged not to be caused by a fire hazard based on the ratio; wherein the wavelength of the first transmitted signal is different from that of the second transmitted signal. In the embodiment of the invention, the smoke generated by the combustion of each substance corresponds to a ratio, and the ratio has a one-to-one correspondence with the type of smoke. The smoke that is not caused by a fire hazard can include cooking smoke such as steak grilling smoke and frying smoke. Specifically, for the above smoke, the alarm does not need to sound an alarm. In order to solve the problem of a false alarm by the smoke alarm, it is necessary to reduce the alarm sensitivity of the smoke alarm, which can be achieved by increasing the smoke alarm threshold of the smoke alarm. The wavelength of the first transmitted signal is different from that of the second transmitted signal, and different types of smoke can be judged based on the ratio between the electrical signal increments caused by the two signals.

In the embodiment of the invention, a smoke density detection period is adjusted to accelerate the detection frequency of smoke, a ratio of an electrical signal increment caused by a first transmitted signal to an electrical signal increment caused by a second transmitted signal is calculated to judge the type of smoke so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm. In the invention, different types of smoke can be identified and different alarm modes can be selected to solve the problem of a false alarm by the smoke alarm.

Figure 2:
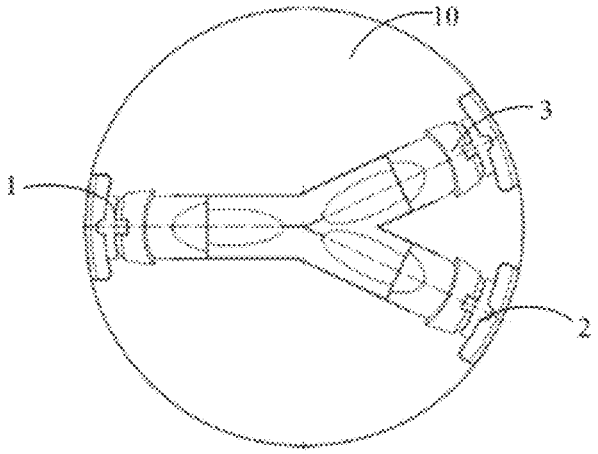
FIG. 2 is a schematic structural view of a smoke alarm provided by an embodiment of the invention.

As shown, FIG. 2 is a schematic structural view of a smoke alarm provided by an embodiment of the invention. Only the parts related to the embodiment of the invention are shown for ease of explanation. The smoke alarm comprises: a first signal transmitter 2; a second signal transmitter 3; and a signal receiver 1 for receiving signals transmitted by the first signal transmitter 2 and the second signal transmitter 3; wherein the first signal transmitter 2 and the second signal transmitter 3 are respectively disposed at different positions within a chamber 10; and the wavelength of the signals transmitted by the first signal transmitter 2 and the second signal transmitter 3 is different.

The first signal transmitter 2 and the second signal transmitter 3 may be respectively referred to as a first signal transmitting tube and a second signal transmitting tube, and the signal receiver 1 may be referred to as a signal receiving tube. The first signal transmitter 2 may be an infrared transmitting tube or a visible light transmitting tube, and the second signal transmitter 3 may be an infrared transmitting tube or a visible light transmitting tube. The visible light transmitting tube may be a red LED transmitting tube, a blue LED transmitting tube or the like.

In the embodiment of the invention, the smoke alarm of the invention can detect a first transmitted signal by the first signal transmitter 2 and a second transmitted signal by the second signal transmitter 3, so that the type of current smoke can be identified based on a ratio of an electrical signal increment caused by the first transmitted signal to an electrical signal increment caused by the second transmitted signal, and the smoke alarm selects different alarm modes based on different types of smoke, thereby solving the problem of a false alarm by the smoke alarm.

Figure 3:
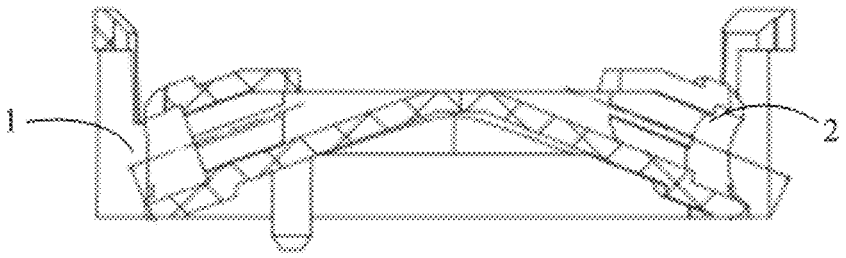
FIG. 3 is a schematic view showing a spatial arrangement of a first signal transmitter and a signal receiver in a smoke alarm provided by an embodiment of the invention.

As shown, FIG. 3 is a schematic view showing a spatial arrangement of a first signal transmitter and a signal receiver in a smoke alarm provided by an embodiment of the invention.

The spatial three-dimensional angle between the first signal transmitter 2 and the signal receiver 1 in the smoke alarm is 0°-180°. The spatial three-dimensional angle may be an included angle between a front straight line of a receiving center of the signal receiver 1 and a front straight line of a transmitting center of the first signal transmitter 2. The front straight line of the receiving center of the signal receiver 1 and the front straight line of the receiving center of the first signal transmitter 2 can intersect in different planes. When the angle is 0°, the signal receiver 1 and the first signal transmitter 2 can be disposed in different planes in the same direction. In this way, the first signal transmitter 2 and the signal receiver 1 have an incident angle relative to each other, and in the absence of smoke, the signal receiver does not receive a signal transmitted by the first signal transmitter 2, or receives a weak signal which is stable. However, in the presence of smoke, a signal transmitted by the first signal transmitter 2 is scattered by the smoke to the signal receiver 1, so that the signal receiver can accurately receive a first transmitted signal transmitted by the first signal transmitter 2 that can represent a smoke signal.

In the embodiment of the invention, the sensitivity of the alarm to detect smoke can be improved by setting the spatial three-dimensional angle between the first signal transmitter 2 and the signal receiver 1.

Still further, the signal transmitted by the first signal transmitter 2 is infrared light. The first signal transmitter 2 may be an infrared transmitting tube which has the advantages of low cost, small power consumption, fast response and stability, thereby further improving the detection accuracy of the smoke alarm.

Still further, the spatial three-dimensional angle between the second signal transmitter 3 and the signal receiver 1 is 0°-180°. The spatial three-dimensional angle may be an included angle between a front straight line of a receiving center of the signal receiving tube 1 and a front straight line of a transmitting center of the second signal transmitter 3. The front straight line of the receiving center of the signal receiving tube 1 and the front straight line of the receiving center of the second signal transmitter 3 can intersect in different planes. When the angle is 0°, the signal receiver 1 and the second signal transmitter 3 can be disposed in different planes in the same direction. In this way, the second signal transmitter 3 has an incident angle to the signal receiver 1, and in the absence of smoke, the signal receiver does not receive a signal transmitted by the second signal transmitter 3, or receives a weak signal which is stable. However, in the presence of smoke, a signal transmitted by the second signal transmitter 3 is scattered by the smoke to the signal receiver 1, so that the signal receiver can accurately receive a second transmitted signal transmitted by the second signal transmitter 3 that can represent a smoke signal.

In the embodiment of the invention, the sensitivity of the alarm to detect smoke can be improved by setting the spatial three-dimensional angle between the second signal transmitter 3 and the signal receiver 1.

Still further, the signal transmitted by the second signal transmitter 3 is visible light. The second signal transmitter 3 is a visible light transmitter, e.g. a red LED transmitter or a blue LED transmitter. The visible light transmitter has the advantages of low cost, small power consumption, fast response and stability, thereby further improving the detection accuracy of the smoke alarm.

In the invention, as shown in FIG. 2, the first signal transmitter 2, the second signal transmitter 3 and the signal receiver 1 are arranged in a "Y" shape in the chamber 10. In this way, the first signal transmitter 2 and the second signal transmitter 3 respectively have an incident angle to the signal receiver 1, and in the presence of smoke, signals transmitted by the first signal transmitter 2 and the second signal transmitter 3 are easily scattered by the smoke to the signal receiver 1.

In the embodiment of the invention, the sensitivity of the smoke alarm to detect a smoke signal is further improved to accurately detect the first transmitted signal and the second transmitted signal.

Figure 4:
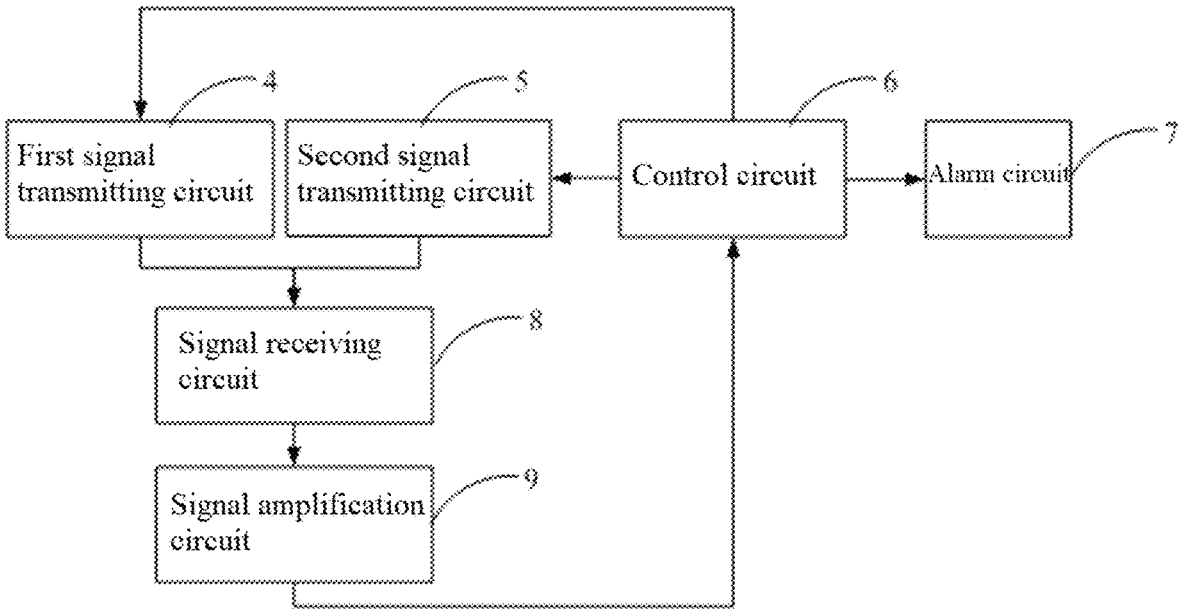
FIG. 4 is a schematic structural view of a smoke type identification circuit provided by an embodiment of the invention.

As shown, FIG. 4 is a schematic structural view of a smoke type identification circuit provided by an embodiment of the invention. The smoke type identification circuit comprises a control circuit 6, a first signal transmitting circuit 4 connected to the control circuit 6 for driving the first signal transmitter 2, a second signal transmitting circuit 5 connected to the control circuit 6 for driving the second signal transmitter 3, and a signal receiving circuit 8 connected to the control circuit 6 for driving the signal receiver 1; wherein the first signal transmitting circuit 4 is connected between the control circuit 6 and the signal receiving circuit 8, the second signal transmitting circuit 5 is connected between the control circuit 6 and the signal receiving circuit 8, and the signal receiving circuit 8 is connected to the control circuit 6.

In the embodiment of the invention, a smoke signal can be detected by the first signal transmitter 2 and the second signal transmitter 3 and then processed by the control circuit, different types of smoke are identified according to the processing result, and then different alarm modes are selected based on different types of smoke, thereby solving the problem of a false alarm by the smoke alarm.

Still further, the smoke type identification circuit further comprises a signal amplification circuit 9 connected between the signal receiving circuit 8 and the control circuit 6.

In the embodiment of the invention, the signal amplification circuit 9 can amplify a smoke signal received by the signal receiver 1 corresponding to the signal receiving circuit 8, so that the control circuit 6 can obtain a more stable smoke signal, thereby improving the success rate of smoke type identification. In this way, the smoke type identification circuit can accurately identify the type of smoke, and then different alarm modes are selected based on different types of smoke, thereby solving the problem of a false alarm by the smoke alarm.

Still further, the smoke type identification circuit further comprises an alarm circuit 7 connected to the control circuit 6 for alarming.

In the embodiment of the invention, after the type of smoke is identified, the smoke alarm threshold is adjusted based on different types of smoke. The smoke alarm threshold is increased if smoke is not caused by a fire hazard, thereby reducing the sensitivity of the smoke alarm and avoiding a false alarm by the smoke alarm.

In the above embodiment, a power supply is further included, which is not shown in the drawing; and power supplies in the respective embodiments of the invention can be selected as needed.

In the embodiment of the invention, the control circuit 6 in the smoke type identification circuit can be achieved by a single-chip microcomputer. Upon smoke detection, the control circuit 6 turns on the first signal transmitting circuit 4 to drive the first signal transmitter 2 to transmit an optical signal, and meanwhile turns on the second signal transmitting circuit 5 to drive the second signal transmitter 3 to transmit an optical signal. In the case of smoke, due to the reflection and scattering effects of smoke particles, the signal receiving circuit 8 drives the signal receiver 1 to receive optical signals transmitted by the first signal transmitter 2 and the second signal transmitter 3 respectively and to convert the optical signals into electrical signals respectively, and the control circuit 6 samples the electrical signals amplified by the signal amplification circuit 9. A ratio of an electrical signal increment caused by a first transmitted signal to an electrical signal increment caused by a second transmitted signal is calculated to judge the type of the smoke, and if the smoke is not caused by a fire hazard, the sensitivity of the smoke alarm is reduced, for example, by increasing the smoke alarm threshold of the smoke alarm, thereby solving the problem of a false alarm by the smoke alarm.

In the embodiment of the invention, the control circuit 6 automatically enters a sleep state in the non-detection period so as to reduce the energy consumption of the smoke alarm, and in a predetermined detection period, the first signal transmitting circuit 4 and the second signal transmitting circuit 5 are turned on to transmit optical signals for smoke detection.

In the embodiment of the invention, a smoke detection device is configured in the control circuit to detect the type of smoke, wherein a ratio of an electrical signal increment caused by a first transmitted signal to an electrical signal increment caused by a second transmitted signal is calculated to judge the type of the smoke, and if the smoke is not caused by a fire hazard, the alarm sensitivity of the smoke alarm is reduced, for example, by increasing the smoke alarm threshold, thereby solving the problem of a false alarm by the smoke alarm.

Figure 5:
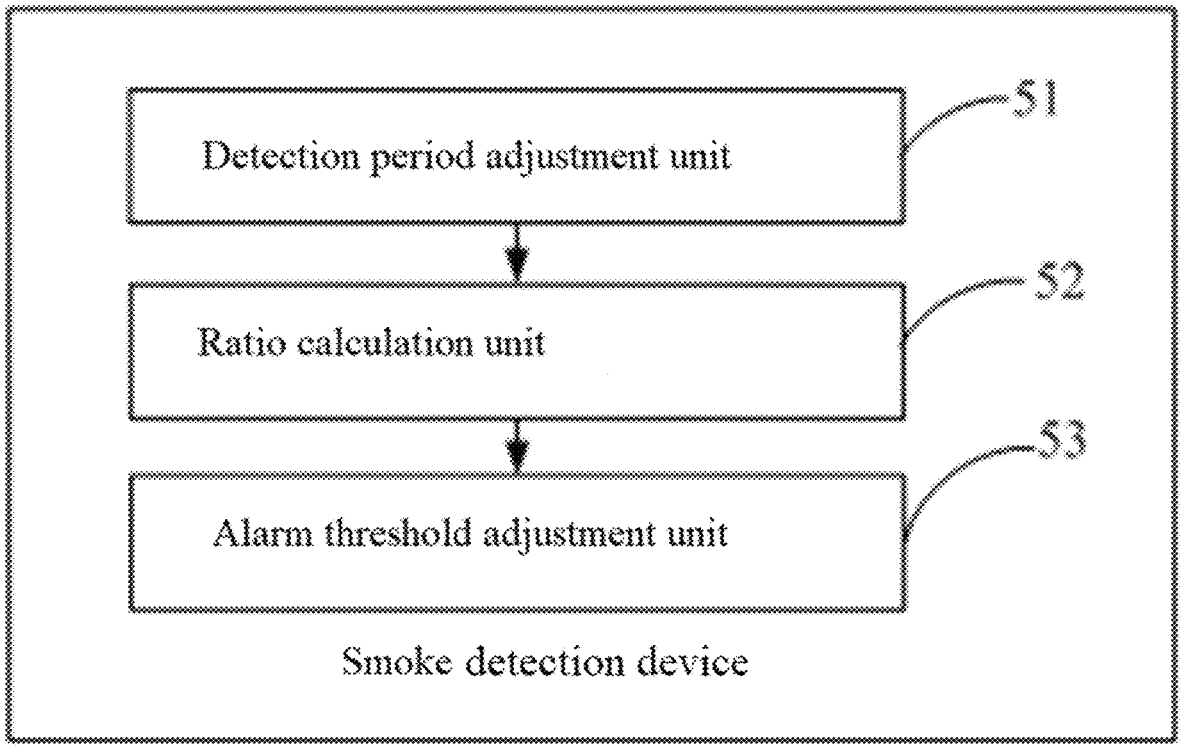
FIG. 5 is a schematic structural view of a smoke detection device provided by an embodiment of the invention.

As shown, FIG. 5 is a schematic structural view of a smoke detection device provided by an embodiment of the invention. Only the parts related to the embodiment of the invention are shown for ease of description.

A detection period adjustment unit 51 is configured to adjust a current detection period of a smoke alarm to be a rapid detection period to accelerate the detection frequency of the smoke density when a current smoke density is detected to meet a set density threshold.

The smoke alarm is generally supplied with power by a battery. In order to extend the service life of the battery, the smoke alarm detects smoke once at a predetermined time (for example, every 8 seconds) under the normal standby condition, i.e. clean air, which can save power consumption and does not affect smoke detection.

A ratio calculation unit 52 is configured to calculate a ratio of an electrical signal increment caused by a first transmitted signal to an electrical signal increment caused by a second transmitted signal.

Specifically, received signal values generated by a signal receiver after two transmitters transmit signals are relatively fixed under clean air, but when smoke enters a sensor, received electrical signals generated by the receiver after the transmitters transmit signals increase. The higher the smoke density, the greater the electrical signal until the electrical signal is saturated. Since the wavelength of the signals transmitted by the two transmitters is different, different electrical signal increments are generated by the same smoke, and their electrical signal increments have a certain fixed ratio; and since the particle size of different kinds of smoke is different, different signal increment values are generated by the same transmitted signal, such that received electrical signal increments generated by the signal receiver after the two signal transmitters transmit signals for different types of smoke have different ratios, thus different types of smoke can be distinguished based on such ratio. For example, the ratio of signal value increments generated by burning newspaper is 2; and the ratio of signal value increments generated by grilling steaks is 3. The second transmitted signal is visible light or infrared light.

An alarm threshold adjustment unit 53 is configured to increase a smoke alarm threshold of the smoke alarm when smoke is judged not to be caused by a fire hazard based on the ratio; wherein the wavelength of the first transmitted signal is different from that of the second transmitted signal.

In the embodiment of the invention, the smoke generated by the combustion of each substance corresponds to a ratio, and the ratio has a one-to-one correspondence with the type of smoke. The smoke that is not caused by a fire hazard can include cooking smoke such as steak grilling smoke and frying smoke. Specifically, for the above smoke, the alarm does not need to sound an alarm. In order to solve the problem of a false alarm by the smoke alarm, it is necessary to reduce the alarm sensitivity of the smoke alarm, which can be achieved by increasing the smoke alarm threshold of the smoke alarm. The wavelength of the first transmitted signal is different from that of the second transmitted signal, and different types of smoke can be judged based on the ratio between the electrical signal increments caused by the two signals.

In the embodiment of the invention, a smoke density detection period is adjusted to accelerate the detection frequency of smoke, a ratio of an electrical signal increment caused by a first transmitted signal to an electrical signal increment caused by a second transmitted signal is calculated to judge the type of smoke so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm. In the invention, different types of smoke can be identified and different alarm modes can be selected to solve the problem of a false alarm by the smoke alarm.

An embodiment of the invention provides a smoke alarm, which comprises the smoke detection device provided by the above embodiment.

In the embodiment of the invention, a smoke density detection period is adjusted to accelerate the detection frequency of smoke, a ratio of an electrical signal increment caused by a first transmitted signal to an electrical signal increment caused by a second transmitted signal is calculated to judge the type of smoke so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm. In the invention, different types of smoke can be identified and different alarm modes can be selected to solve the problem of a false alarm by the smoke alarm.

An embodiment of the invention provides a smoke alarm, which comprises a processor, and a memory connected to the processor via a communication bus.

The memory is configured to store a smoke detection program.

The processor is configured to execute the smoke detection program to implement the smoke detection method. The processor executes the steps of:

adjusting a current detection period of a smoke alarm to be a rapid detection period to accelerate the detection frequency of the smoke density when a current smoke density is detected to meet a set density threshold;

calculating a ratio of an electrical signal increment caused by a first transmitted signal to an electrical signal increment caused by a second transmitted signal; and increasing a smoke alarm threshold of the smoke alarm when smoke is judged not to be caused by a fire hazard based on the ratio.

The wavelength of the first transmitted signal is different from that of the second transmitted signal.

Still further, in the steps executed by the processor, the first transmitted signal is infrared light or visible light; and the second transmitted signal is visible light or infrared light.

In the embodiment of the invention, a smoke density detection period is adjusted to accelerate the detection frequency of smoke, the type of smoke is judged based on a ratio of an electrical signal increment caused by a first transmitted signal to an electrical signal increment caused by a second transmitted signal so that the smoke alarm can adjust its smoke alarm threshold before an alarm by different adjustment approaches based on different types of smoke, and the smoke alarm threshold is increased if smoke is not caused by a fire hazard, thereby reducing the sensitivity of the smoke alarm and avoiding a false alarm by the smoke alarm. In the invention, different types of smoke can be identified and different alarm modes can be selected to solve the problem of a false alarm by the smoke alarm.

In addition, a storage medium is further provided, in particular, a computer readable storage medium storing one or more programs, wherein the one or more programs are executable by one or more processors to enable the one or more processors to execute the steps of the above open fire alarm detection method.

The above description only refers to preferred embodiments of the invention and is not intended to limit the invention. Any modification, equivalent replacement and improvement, etc. made within the spirit and principle of the invention shall be included within the protection scope of the invention.

The invention claimed is:

1. A smoke detection method, comprising the steps of:

adjusting a current detection period of a smoke alarm to be a rapid detection period to accelerate the detection frequency of the smoke density when a current smoke density is detected to meet a set density threshold;

calculating a ratio of an electrical signal increment caused by a first transmitted signal to an electrical signal increment caused by a second transmitted signal; and wherein received electrical signals generated by the receiver after the transmitters transmit signals increase, and the higher the smoke density, the greater the electrical signal until the electrical signal is saturated; and increasing a smoke alarm threshold of the smoke alarm when smoke is judged not to be caused by a fire hazard based on the ratio;

wherein the wavelength of the first transmitted signal is different from that of the second transmitted signal, and different types of smoke is judged based on a ratio between the electrical signal increments caused by the two signals.

2. The method according to claim 1, wherein the first transmitted signal is infrared light or visible light.

3. The method according to claim 1, wherein the second transmitted signal is visible light or infrared light.

4. A smoke detection device, comprising:

a detection period adjustment unit configured to adjust a current detection period of a smoke alarm to be a rapid detection period to accelerate the detection frequency of the smoke density when a current smoke density is detected to meet a set density threshold;

a ratio calculation unit configured to calculate a ratio of an electrical signal increment caused by a first transmitted signal to an electrical signal increment caused by a second transmitted signal;

wherein received electrical signals generated by the receiver after the transmitters transmit signals increase, and the higher the smoke density, the greater the electrical signal until the electrical signal is saturated; and an alarm threshold adjustment unit configured to increase smoke alarm threshold of the smoke alarm when smoke is judged not to be caused by a fire hazard based on the ratio; wherein the wavelength of the first transmitted signal is different from that of the second transmitted signal, and different types of smoke is judged based on a ratio between the electrical signal increments caused by the two signals.

5. The smoke detection device according to claim 4, wherein the first transmitted signal is infrared light or visible light.

6. The smoke detection device according to claim 4, wherein the second transmitted signal is visible light or infrared light.

7. A smoke alarm, comprising the smoke detection device according to claim 4.

8. A smoke alarm, comprising a processor, and a memory connected to the processor via a communication bus; wherein, the memory is configured to store a smoke detection program; and the processor is configured to execute the smoke detection program to implement the smoke detection method according to claim 1.

9. A storage medium, the storage medium storing one or more smoke detection programs, and the one or more smoke detection programs being executable by one or more processors to enable the one or more processors to execute the steps of the smoke detection method according to claim 1.

* * * * *